US006880719B1

(12) United States Patent
Sutton et al.

(10) Patent No.: US 6,880,719 B1
(45) **Date of Patent: *Apr. 19, 2005**

(54) TANK FOR CRYOGENIC LIQUIDS

(75) Inventors: Harold E. Sutton, Fort Collins, CO (US); Roy E. Adkins, Catlett, VA (US)

(73) Assignee: Cryogenic Fuels, Inc., Catlett, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,047

(22) Filed: Oct. 31, 1997

Related U.S. Application Data

(60) Provisional application No. 60/030,156, filed on Oct. 31, 1996.

(51) Int. Cl.[7] ..... F17C 1/02
(52) U.S. Cl. ..... 220/560.1
(58) Field of Search ..... 220/560.1, 560.11, 220/560.04, 564, 560.07, 560.08, 560.14, 560.15, 592.2, 592.25, 592.26, 592.27, 586, 585, 562, 506, 653, 751, 4.12, 4.14, 23.86, 23.83, 901

(56) References Cited

U.S. PATENT DOCUMENTS 3,123,762 A * 3/1964 Gabarro et al. ..... 220/560.1
3,163,313 A 12/1964 Reynolds et al.
3,246,788 A * 4/1966 Mayer ..... 220/4.12
3,272,375 A * 9/1966 Holcombe et al. ..... 220/560.1
3,341,215 A 9/1967 Spector
3,650,290 A * 3/1972 Moen et al. ..... 137/339
3,764,036 A 10/1973 Dale et al.
3,782,128 A 1/1974 Hampton et al.
4,291,541 A 9/1981 Kneip, Jr. et al.
4,496,073 A 1/1985 Silver et al.
4,606,196 A * 8/1986 Acharya et al. ..... 62/46.3
5,063,651 A * 11/1991 Kneip, Jr. et al. ..... 29/455.1

* cited by examiner

*Primary Examiner*—Stephen Castellano

(57) ABSTRACT

A tank for cryogenic liquid fuel includes a tank with inner and outer shells. A support beam with its ends supported in endwalls of the outer shell extends through a central sleeve in the inner shell. Raised formations on the support beam engage the interior of the sleeve to support the inner shell within the outer shell. The sealed space formed between the shells inhibits heat conduction into cryogenic liquid fuel held in the inner shell. Pins extending transversely through the support beam prevent turning of the support beam in its endwall supports and turning of inner shell about the support beam. Getter material and radiation shielding placed about the support beam within the sleeve of the inner shell afford additional impediments to heat transfer into the inner shell.

6 Claims, 3 Drawing Sheets

TANK FOR CRYOGENIC LIQUIDS

This application claims priority on provisional application Ser. No. 60/030,156 filed on Oct. 31. 1996, the entire contents of which are hereby incorporated by reference.

INTRODUCTION

The present invention is directed to a tank for receiving and holding an extremely cold liquid. More particularly, the present invention is directed to a vehicle-mounted tank for receiving and holding a cryogenic liquid fuel The liquids intended for transfer by the apparatus and method of this invention exist in a cryogenic state. The present invention is particularly adapted for, but not limited to, a vehicle-mounted tank for efficiently holding liquefied natural gas (LNG), or methane.

Typically, LNG vehicle fuel tanks are of double wall construction. The inner shell, a pressure vessel containing LNG fuel, is supported within the outer shell. Radiation shielding, such as wraps of polyester sheet aluminized on both sides, is placed in the space between the inner and outer shells, and the space is placed under a high vacuum to provide particularly effective insulation between the inner shell and the ambient. Since LNG is a cryogenic fuel that boils at −258° F. (at normal atmospheric pressure), the pressure vessel support structure must exhibit a very low conductive heat leak. This low heat leak minimizes tank pressure build-up during vehicle non-operational time periods and prevents venting of fuel during a designed "no vent" standby time. The pressure vessel support structure must also be designed to withstand vehicle over-the-road vibration and repeated high shock impact loading on all axes. The support structure must accommodate this high dynamic loading over the life of the vehicle without cyclic fatigue or material creep failure.

The pressure vessel support, as employed in this invention, is a central beam design with fixed socket supports at each end of the outer shell. The beam configuration is ideally suited to provide long conductive heat paths from the locations of pressure vessel support to the ends in the fixed socket supports in the outer shell. Also, by proper sizing, the beam configuration can also accommodate very high dynamic loads along all axes with high margins of safety.

To the extent necessary, the entire disclosure of U.S. Pat. No. 5,353,849, which issued to Harold E. Sutton and Roy E. Adkins, is hereby incorporated by reference.

TANK CONSTRUCTION

Figure 1:
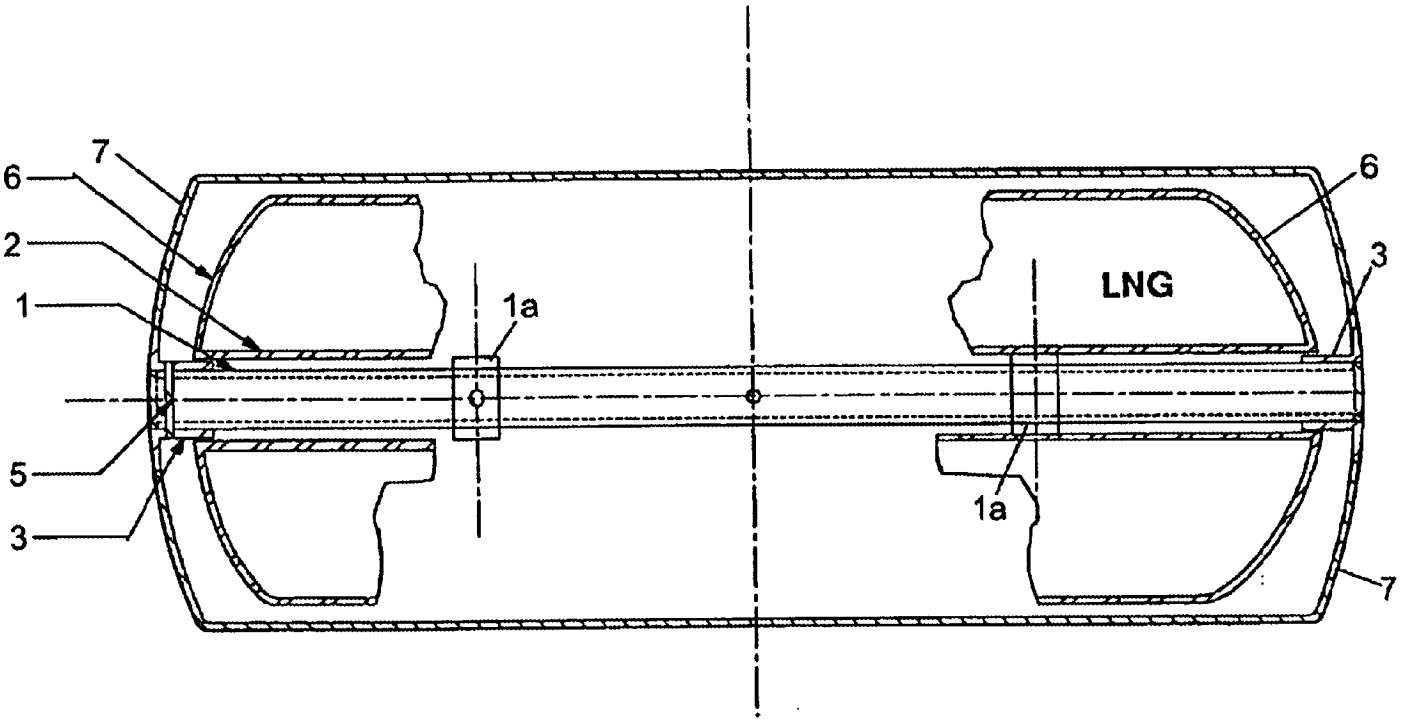
FIG. 1 is a cross-sectional illustration of a preferred tank construction.
Figure 2:
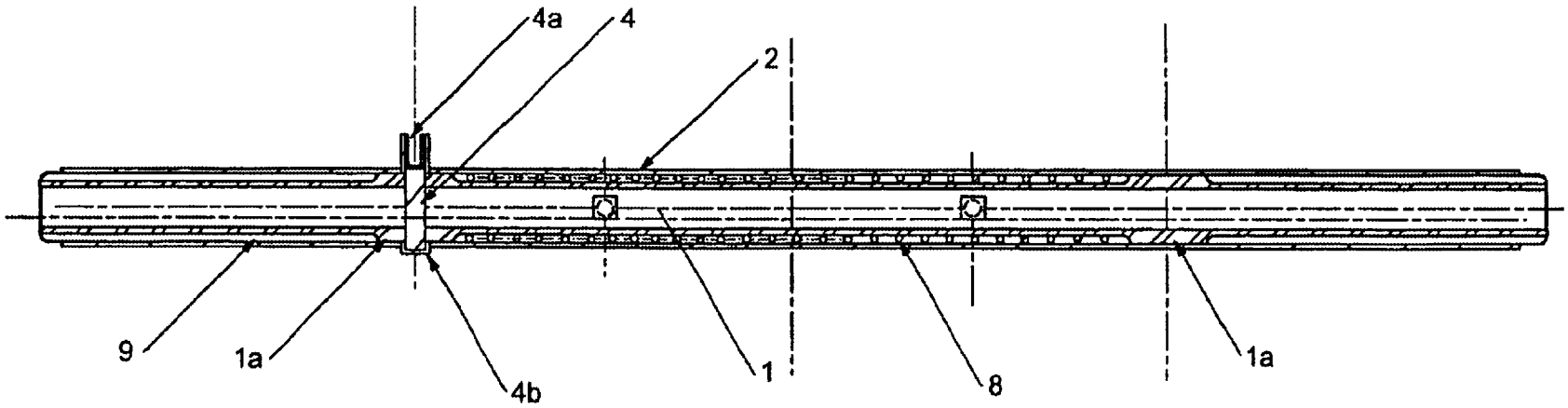
FIG. 2 is a cross-sectional illustration showing details of the support beam used in the tank shown in FIG. 1.
Figure 3:
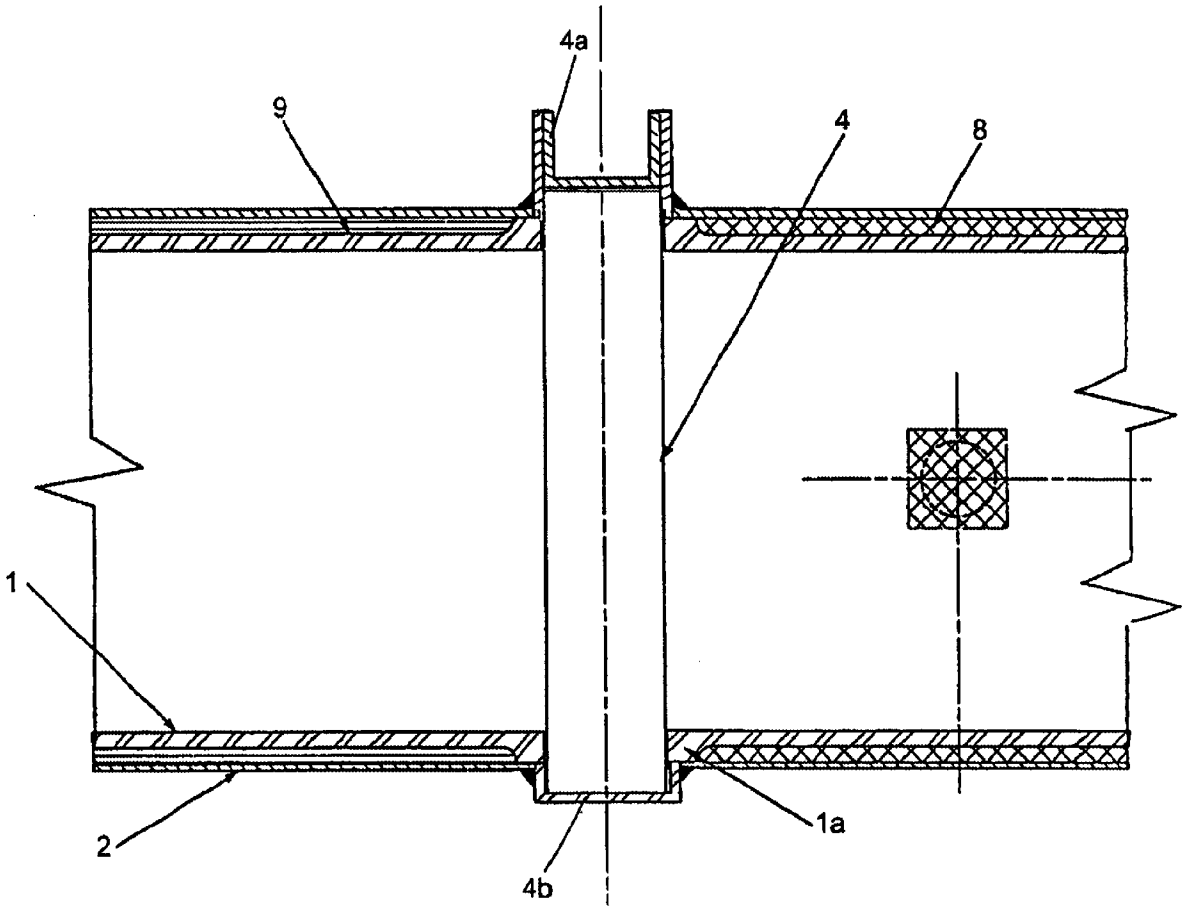
FIG. 3 is a cross-sectional illustration showing details of a lock pin used in the support beam shown in FIG. 2

A preferred tank construction is shown in FIGS. 1–3 and comprises a hollow beam 1 fabricated from high strength low thermal conductivity material such as Grade 11 fiberglass that is compatible with LNG. The beam is contained within a pressure vessel support tube 2 which bears against beam collars 1*a* formed integrally with the beam. The support tube 2 is welded at each end into the pressure vessel heads 6. The beam is supported at both ends by insertion into socket supports 3 that are welded to the inside of the outer shell heads 7. The transverse pressure vessel loads are borne by the beam 1 in bending and vertical shear and transmitted to the socket supports 3. The applied longitudinal tank loads are borne by a lock pin 4 inserted transversely through the beam 1 and pressure vessel support pipe 2, as best shown in FIG. 3. Pin 4 is contained in a transverse sleeve welded into the support pipe. To maintain vacuum integrity, the ends of the sleeves are sealed by welded closure fittings 4*a*, 4*b*. Pin 4 also receives pressure vessel rotational (torsional) loads and transmits these loads to an outer shell socket support 3 via beam 1 and another pin 5 fastened to the socket and extending transversely through an end of the beam.

As an aid to retaining the vacuum between the inner and outer tank shells, a getter 8, such as activated charcoal is placed into the annular space between the pressure vessel support tube 2 and beam 1 between load support collars 1*a*, as best shown in FIGS. 2 and 3. The getter absorbs moisture and hydrocarbons to inhibit gas heat conduction through migration of molecules. The space between the tube 2 and the beam 1 between load support collars 1*a* provides a favorable location for the getter which affords good contact of the getter with the cold pressure vessel support tube 2 to thus ensure getter efficiency. Also, an appropriate molecular sieve material (such as silver zeolite) is placed within the vacuum annulus between the pressure vessel head 6 and outer shell head 7.

To minimize radiant heat transfer from the beam into the LNG which surrounds the pressure vessel support tube, alternating layers of radiation shielding 9 and a spacer material are disposed in the annular space between the beam 1 and tube 2 at each end of the beam. Polyester sheet aluminized on both sides can serve as a suitable radiation shield, and Nylon netting can serve as the spacer. Preferably, several wraps of the radiation shield and intervening spacer are located between the tube 2 and beam 1 in the space extending from the beam collars 1*a* to the socket supports 3 at each end of the tank. The inside of the beam is filled with radiation shielding, aluminized polyester sheet, to prevent trapping radiation in a "black hole."

The pressure vessel support beam can be configured for any tank size and configuration to accommodate very high vehicle cyclic dynamic loading as induced by typical over-the-road operation. The proper detail design/sizing will ensure no fatigue or material creep failure for the life of the vehicle. The support beam design is capable of carrying repetitive high shock impact loads along all axes while exhibiting a very low conductive heat leak. As an example, a cylindrical 26-inch diameter fuel tank, containing 100 gal. of LNG, can exhibit a total tank heat leak (in a 90° F. temperature environment) of 11 Btu/hr using the described pressure vessel support beam. This thermal performance is based on a superinsulated tank using multi-layer radiation shielding in a high $10^{-}5$ to $10^{-6}$ mmHg vacuum range. The conductive heat leak of the pressure vessel support beam is 1.4 Btu/hr, which is less than 13% of the total tank heat leak.

What is claimed is:

1. A tank assembly for holding a cryogenic liquid, comprising:

an inner shell including a first shell body extending between first and second endwalls and a sleeve extending along a longitudinal axis between the first and second endwalls to form, with the first shell body and the first and second endwalls, a generally annular space for holding a cryogenic liquid;

an outer shell including a second shell body extending between third and fourth endwalls, the outer shell being disposed about the inner shell to form a sealed space between the two shells which inhibits the transfer of heat from the outer shell to the inner shell;

a support beam supported by and extending between the third and fourth endwalls and through the sleeve to provide support for the inner shell within the outer shell;

a pair of raised formations on the support beam fitting closely within the sleeve for engaging the interior of the sleeve while minimizing heat transfer between the support beam and the sleeve, the raised formations being spaced form each other and from the ends of the support beam; and a pin extending transversely through the sleeve and through one of the raised formations for inhibiting turning of the two shells with respect to each other about the longitudinal axis.

2. The tank assembly as recited in claim 1, and further comprising getter material disposed between the sleeve and the support beam and between the raised formations for inhibiting gas heat conduction between the support beam and the sleeve.

3. The tank assembly as recited in claim 2, wherein the getter material comprises activated charcoal.

4. The tank assembly as recited in claim 1, and further comprising radiation shielding disposed between the sleeve and the support beam and between the raised formations and the ends of the support beam.

5. The tank assembly as recited in claim 4, wherein the radiation shielding comprises spaced layers of aluminized sheet material.

6. A tank assembly for holding a cryogenic liquid, comprising:

an inner shell including a first shell body extending between first and second endwalls and a sleeve extending along a longitudinal axis between the first and second endwalls to form, with the first shell body and the first and second endwalls, a generally annular space for holding a cryogenic liquid;

an outer shell: including a second shell body extending between third and fourth endwalls, the outer shell being disposed about the inner shell to form a sealed space between the two shells which inhibits the transfer of heat from the outer shell to the inner shell;

a support beam supported by and extending between the third and fourth endwalls and through the sleeve to provide support for the inner shell within the outer shell;

at least one raised formation on the support beam fitting closely within the sleeve for engaging the interior of the sleeve while minimizing heat transfer between the support beam and the sleeve; and means for inhibiting turning of the two shells with respect to each other about the longitudinal axis, the means for inhibiting turning comprising a pin extending transversely through the sleeve and through the raised formation.

* * * * *